United States Patent [19]

Aario

[11] 4,193,865

[45] Mar. 18, 1980

[54] CLASSIFYING APPARATUS FOR A SUSPENSION

[75] Inventor: Matti Aario, Tampere, Finland

[73] Assignee: Oy Tampella AB, Tampere, Finland

[21] Appl. No.: 910,434

[22] Filed: May 30, 1978

Related U.S. Application Data

[63] Continuation of Ser. No. 777,789, Mar. 15, 1977, abandoned.

[30] Foreign Application Priority Data

Mar. 16, 1976 [FI] Finland ..... 760686

[51] Int. Cl.[2] ..... B07B 1/20

[52] U.S. Cl. ..... 209/240; 209/273; 209/379; 210/415

[58] Field of Search ..... 209/273, 284, 286, 288, 209/300, 303, 305, 379, 304, 306, 240; 210/415

[56] References Cited

U.S. PATENT DOCUMENTS

| | | | |
|---|---|---|---|
| 3,970,548 | 7/1976 | Seifert et al. | 209/306 |
| 3,997,441 | 12/1976 | Pamplin | 210/415 |

*Primary Examiner*—Robert Halper
*Assistant Examiner*—Jon E. Hokanson
*Attorney, Agent, or Firm*—Roylance, Abrams, Berdo & Farley

[57] ABSTRACT

A classifying apparatus for a suspension, especially for a pulp suspension, having a screen drum, means for feeding the suspension to one side of the screen drum, for removing thickened suspension from the same side of the screen drum and liquid from the opposite side of the screen drum, blades inclined in relation to their direction of rotation so that any one of the ends of the inclined blades is substantially on the same screen drum line parallel to the screen drum axis as the opposite end of some other blade and fitted to sweep at least one surface of the screen drum, and driving means for moving the blades in relation to the screen drum.

3 Claims, 1 Drawing Figure

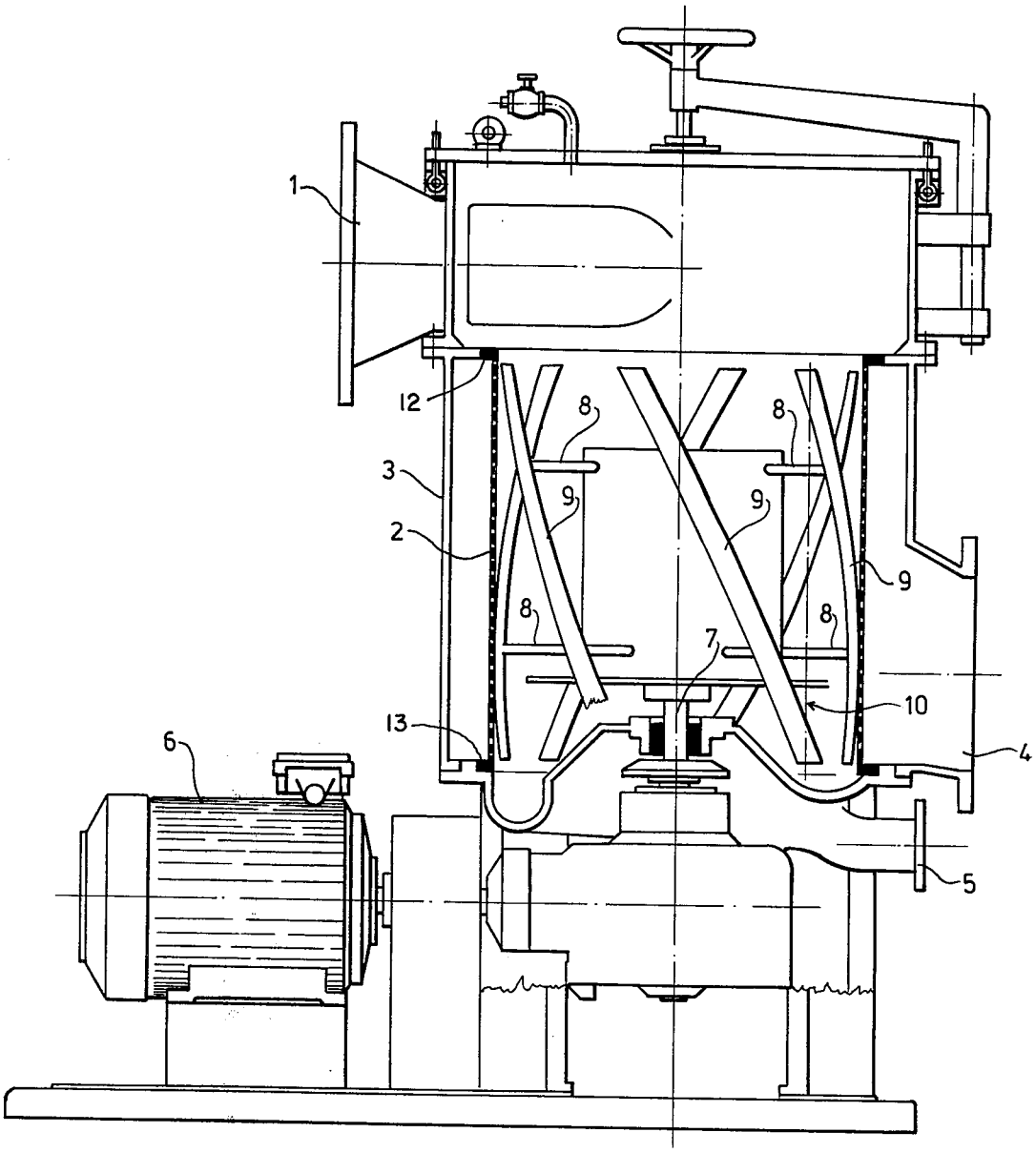
1
12
8
8
3
9
9
2
9
8
8
7
10
13
6
4
5

CLASSIFYING APPARATUS FOR A SUSPENSION

This is a continuation of application Ser. No. 777,789, filed Mar. 15, 1977, now abandoned.

The present invention relates to a classifying apparatus for a suspension and especially for a pulp suspension, having a screen drum which allows the accept or only liquid to pass through it and retains the reject or the thickened suspension. The invention relates in particular to a classifying apparatus having blades substantially parallel to the screen drum, which sweep along the screen drum surface and are formed to generate hydraulic impulses to promote the detaching of the solids attached to the screen drum surface and their conveying towards the outlet. The blades are mounted to form an angle with the axis of the screen drum to damp the impulses generated by the blades.

BACKGROUND OF THE INVENTION

Previously known are classifiers provided with a screen drum in which the pulp to be screened is forced through screen aperture of a certain size, so that the accept pulp passes through the screen drum and the reject pulp does not. In order that the screen drum not be clogged, it has been provided with rotating blades which produce hydraulic impulses to detach the clogging pulp from the surface of the screen drum. Often, the blades have been fitted obliquely to the longitudinal axis of the screen drum in order to promote the movement of the reject pulp in the desired direction, i.e., towards the reject outlet pipe.

The screen drum cleaning impulses create hydraulic pulsation in the pulp suspension being screened. This hydraulic pulsation has proven detrimental, for example, when the screen classifiers have been placed prior to the paper machine head box. The paper machine head box has not in all cases been capable of dampening the pulsation sufficiently, with the result that part of the pulsation has remained undampened and has caused pulp density (surface weight) variation in the paper being manufactured, mainly in its longitudinal direction.

BRIEF SUMMARY OF THE INVENTION

The object of the present invention is to reduce the detrimental pulsation caused by the blades, without reducing the effect of the impulses which clean the screen drums.

According to the present invention there is now provided a classifying apparatus in which an end of any inclined blade and the opposite end of some other blade are approximately on the same line on the circumference of the screen drum, the line being parallel to the axis of the screen drum. The pulsation can further be dampened by fitting such blades on both sides of the screen and by rotating them in opposite directions.

DESCRIPTION OF THE INVENTION

The best dampening of pulsation is achieved if the approximate center of each end of each blade and respectively the opposite end of some other blade are exactly on the same line of the screen drum, the line being parallel to the screen drum axis. However, variations of a circle sector of approx. 5 degrees can be allowed without substantially worsening the dampening of pulsation achieved by the invention. According to the invention, the opposite end of every second, third, or the next blade can also be on the same line, i.e., the blades partially overlap.

The invention is described below in more detail with reference to the enclosed drawing, which depicts a side elevation, partially as a cross section, of a preferred embodiment of the invention, by means of which the hydraulic pulsation on the accept side has been reduced by 40%.

The pulp to be screened is fed in tangentially through an inlet 1 in the upper part of the classifier shown in the drawing. From the upper part of the classifier the pulp to be screened flows downwards through a vertical screen drum 2 which is supported between members 12 and 13 in conventional fashion as graphically illustrated. The drum is provided with a plurality of perforations or apertures along a portion of its axial extent. Accept from the pulp suspension passes through the apertures in the apertured portion of the screen drum 2 into the annular space between the screen drum 2 and the classifier mantle 3 and is removed from there through an outlet 4. The reject pulp sinks to the bottom of the classifier from where it is removed through a reject outlet 5.

A shaft 7 rotated by a motor 6 has been fitted centrally and coaxially inside the screen drum 2. Several blades 9 have been attached to the shaft 7 by means of arms 8, the blades 9 extending obliquely from one end of the screen drum 2 to the other end having been fitted to sweep the inner surface of the screen drum 2 very closely so as to detach, by means of hydraulic impulses, the pulp adhering to it.

In order to dampen the pulsations on the accept side, the blades 9 have been fitted according to the invention in such a position that each end of each blade 9 is substantially on the same line 10 parallel to the shaft 7 as the opposite end of the adjacent blade.

According to an alternative embodiment of the invention, blades have been fitted on both the inner and the outer surface of the screen drum, in which case the blades which sweep the inner surface of the screen drum have been fitted to rotate in the direction opposite to the direction of rotation of the blades sweeping the outer surface of the screen drum.

In addition, the blades can be hollow and open towards the screen drum so as to feed a rinsing liquid onto the screen drum or to remove through the blades the pulp detached from the screen drum.

It is also evident that the pulp to be screened can be fed around the screen drum and the accept removed from the inside of the screen drum.

What is claimed is:

1. An improved classifying apparatus for a suspension, especially for a pulp suspension, comprising a generally cylindrical stationary screen drum having a central axis and a plurality of apertures formed therein along a portion of its axial extent through which accept suspension material can pass;

means at both ends of said screen drum for supporting said drum;

means for feeding the suspension to one side of the screen drum;

means for removing reject or thickened suspension from said one side of said screen drum;

means for removing accept suspension or liquid from the opposite side of said screen drum;

sweeping means for generating hydraulic impulses to detach solids attached to said drum;

said sweeping means comprising a plurality of inclined blades;

blade support means for supporting said inclined blades for rotation in a predetermined direction about the central axis of said drum so that said blades are inclined relative to said axis and to their direction of rotation and so that said blades sweep a surface of the screen drum; and driving means connected to said blade support means to establish motion of said blades relative to said surface, said blade support means being arranged to establish the angle of inclination of said blades so that the end portion of each of said blades near one end of said drum overlaps an end portion of at least one other of said blades near the other end of said drum with respect to an axial line along said drum, said overlap being sufficient to dampen said hydraulic impulses and lying axially within said portion of said drum in which said apertures are formed to permit the accept suspension material to pass therethrough.

2. A classifying apparatus according to claim 1 wherein the angular extent of blade overlap, relative to said axial line, is no greater than about 5°.

3. A classifying apparatus according to claim 1 wherein said means for removing accept suspension includes a mantle surrounding and fixedly attached to said drum, said mantle having an outlet for carrying accept away from the region outside of said drum;

said means for feeding includes an inlet conduit for delivering suspension into the interior of said drum at one axial end thereof; and said means for removing reject includes an outlet conduit at the opposite axial end of said drum, and wherein said inclination of said blades and said predetermined direction of rotation are chosen such that the blade ends closest to said outlet conduit pass said line after the ends of the same blades closest to said inlet conduit to convey the reject suspension toward said outlet conduit.

* * * * *